US005178599A

United States Patent [19]

Scott

[11] Patent Number: 5,178,599

[45] Date of Patent: Jan. 12, 1993

[54] BIDIRECTIONAL, SYNCHRONOUS, TOTAL BODY EXERCISE MACHINE

[76] Inventor: Edwin R. Scott, 11072 N. 5020 West, Highland, Utah 84003

[21] Appl. No.: 658,105

[22] Filed: Feb. 20, 1991

[51] Int. Cl.[5] ..... A63B 21/00

[52] U.S. Cl. ..... 482/137; 482/51; 482/96; 482/113; 472/110

[58] Field of Search ..... 482/111-113, 482/133, 135-137, 121-123, 125, 126, 51, 52, 53, 70, 95, 96; 472/106, 108, 110, 112, 113

[56] References Cited

U.S. PATENT DOCUMENTS

| | | | |
|---|---|---|---|
| 1,562,700 | 11/1925 | Herring | 472/110 |
| 2,176,342 | 10/1939 | Hoppe | 482/137 |
| 2,544,106 | 3/1951 | Ray | 472/110 |
| 2,835,563 | 3/1958 | Lawton | 482/112 |
| 4,838,543 | 6/1989 | Armstrong et al. | 482/112 X |
| 4,940,233 | 7/1990 | Boll et al. | 482/51 X |

*Primary Examiner*—Robert Bahr
*Attorney, Agent, or Firm*—Workman, Nydegger & Jensen

[57] ABSTRACT

A bidirectional, synchronous, total body exercise machine. The machine includes bidirectional force-resistance mechanism in the form of a cylinder with a piston and piston rod. A lever is mounted to a framework which includes a vertical support member and a horizontal support member. The piston rod is attached to one end of the lever and the cylinder is attached to the vertical support member of the frame. Foot pedals are attached to one end of the lever and a seat is mounted on the other end of the lever so that a user may be seated on the lever. A stationary handle bar is also provided on the vertical support member so that the user, when seated on the lever, can grasp the stationary handle and then can pull forward with the arms and pushing down on the foot pedals, while at the same time rocking the torso forward, pulling the piston rod downwardly. The piston in then returned by straightening the arms and relaxing the force on the foot pedals, while rocking the torso back. A fluid passageway connects chambers on opposite sides of the piston inside of the cylinder and by adjusting a valve which is positioned in the fluid passageway, the resistance which is offered by the cylinder as it forces the fluid from one chamber to the other can be selectively varied.

29 Claims, 5 Drawing Sheets

BIDIRECTIONAL, SYNCHRONOUS, TOTAL BODY EXERCISE MACHINE

BACKGROUND

1. Field of the Invention

The invention is in the field of exercise machines.

2. The Prior Art

The use of exercise machines has proliferated in the last decade or so, and there is an ever increasing array of exercise machines of many different varieties and types. Some types of exercise machines are quite complex and are structurally heavy, are often times attached to the floor or the wall and are provided with a complicated arrangement of levers, pulleys, weights, etc. This kind of equipment is most frequently found in commercial spas, sports centers and exercise facilities. Other types of exercise machines are designed primarily for home use and are typically simpler, lighter, and much less expensive while still providing versatility with respect to different types of exercises that may be performed. Other types of exercise machines are usable in either a commercial spa or exercise facility or the home.

Many state-of-the-art machines are intended for exercising particular groups of muscles in the arms, legs or trunk. Not uncommonly, a person must move from one machine to another in order to obtain a full range of exercise for all major muscle groups of the arms, legs and trunk. In other types of exercise machines, the user may use the same machine but must vary his or her position on the machine to engage in different exercises in order to exercise the different major muscle groups.

The nature of the exercising movements which are performed on state-of-the-art exercise machines also varies depending upon the type of the machine. Many types of state-of-the-art exercise machines are designed so as to require unidirectional exercising movement. This type of exercising movement is characterized in that typically there is both a forward force stroke and a return force stroke but the body is exercised on only one of the strokes, or in other words in only one direction. Thus, the term "unidirectional" implies with respect to an exercise movement that the part of the body that is being exercised, as for example an arm or a leg, is only working during half of the cycle. An example of a type of exercise machine which is well known in the art in which the type of exercise movement is primarily unidirectional is a rowing machine.

Another, second type of classification with respect to the type of required exercising movement pertains to whether the exercising movement is synchronous or asynchronous. In a synchronous exercising movement the arms or upper extremities and/or the legs or lower extremities move together in the same direction or in synchronization on both the forward force and return strokes of the exercising movement. In asynchronous exercising movements, the upper and/or lower extremities are on opposite strokes or cycles. Examples of asynchronous exercising machines include machines which simulate cross-country skiing, stationary running machines or machines which simulate stair climbing, stationary cycling machines and the like.

Virtually all state-of-the-art exercise machines which are currently known combine the above two described types of exercising movement in one of three different ways: by providing synchronous but unidirectional exercising movement; by providing asynchronous and unidirectional exercising movement; or by providing asynchronous and bidirectional exercising movement.

Furthermore, virtually all exercising machines which are currently known in the art tend to provide exercising movement which is primarily directed to a specific muscle group such as the major muscles of the arms or upper extremities, the major muscles of the legs or lower extremities, or the major muscle groups of the trunk. A few types of exercise machines may require exercising movements which require exercising more than just the major muscle groups in the upper extremities, lower extremities or trunk but few if any require effective simultaneous exercise of all major muscle groups from the upper extremities, lower extremities and trunk. Accordingly, typically added time is required if a person intends to provide adequate exercise for the major muscle groups of all of these areas of his or her body.

BRIEF SUMMARY AND OBJECTS OF THE INVENTION

In contrast to asynchronous exercising movements, synchronous exercising movements tend to exercise much more effectively the major muscle groups in both the extremities and the torso. For example, if a person is sitting in a chair, if one leg is lifted while the other leg is resting on the floor, the leg which is resting on the floor tends to provide stabilization which reduces the work required on a person's trunk while the other leg is being lifted. This can be contrasted with the situation where both legs are lifted off the floor simultaneously while a person is in a sitting position, which will require the trunk muscles to exert substantially more work since the trunk muscles must then stabilize the person's body while both legs are being lifted together or in synchronization. Thus, synchronous exercising movements as opposed to asynchronous exercising movements tend to require a much higher degree the use of a person's major muscle groups in the trunk as well as the extremities.

Furthermore, bidirectional exercising movements as contrasted with unidirectional exercising movements also tend to be much more efficient in exercising the various muscle groups of a person's body. In bidirectional exercising movements the muscle groups which are being exercised must work both on the forward and return strokes thereby requiring more work in less time, as opposed to an asynchronous movement in which the muscle groups must work only on one of the forward or return strokes.

It is a principle object of the present invention to provide a relatively simple exercise machine that can be used either in a home or in a commercial spa, sports center or exercise facility, which will permit the simultaneous, bidirectional, synchronous movement of both the upper and lower extremities as well as a person's trunk so as to require simultaneous use of all major muscle groups in the upper and lower extremities and in the trunk. Thus, the exercise machine of the present invention comprises a synchronous, bidirectional total body exercise machine which represents a significant advancement in the art.

Another important object and advantage of the present invention is the provision of an exercise machine which is highly versatile in that the machine allows efficient and effective exercise of major muscle groups in the upper and lower extremities as well as the trunk without requiring severe bending of a person's knee joints. Persons who may have knee injuries may thus still obtain effective exercise for major muscle groups in the lower extremities or legs without stressing or risking further injury to the injured or damaged knee joint. The same object or advantage is provided by the exercise machine of the present invention with respect to persons who have weak or injured back muscles since the exercise machine of the present invention tends to maintain the proper curvature in a person's lower back while the machine is in use so as not to impose undue stress on the lower back.

Still a further object and advantage of the exercise machine of the present invention is that the machine can be utilized in a variety of ways to emphasize the degree of work required on various muscle groups as desired by a user.

Yet another object and advantage of the exercise machine of this invention is that the machine provides adjustment capability so that the force required to exercise can be readily and easily adjusted by a user to suit personal conditions of physical strength, fitness and conditioning.

Yet another object and advantage of the exercise machine of the present invention is that the machine is easily adjustable to accommodate users having different physical sizes.

The foregoing and other objects and advantages of the invention will become more fully apparent from the summary, detailed description and claims which follow, or may be learned from the practice of the invention.

Briefly summarized, the invention comprises an exercise machine having three major elements, a force-resistance mechanism, a lever serving as a means by which the user actuates the force-resistance mechanism, and a framework that serves to support and cooperatively engage the force-resistance mechanism and the lever.

The force-resistance mechanism is a bidirectional device, requiring a force to activate it in one direction, this force being termed a forward force, and an oppositely directed force to activate it in the reverse direction, termed a return force. Corresponding exercise movements are termed a forward force stroke and a return force stroke. The amount of force required on either or both strokes can be selectively varied by the user.

One presently preferred force-resistance mechanism is a double-acting piston, equipped with a piston rod, housed in a closed-end cylinder wherein there is a fluid chamber on one side of the piston and a fluid chamber on the opposite side of the piston. A fluid passageway, such as a tube, interconnects ports located at respective ends of the cylinder. The cylinder is filled with a fluid which may be either a gas or a liquid, for example air. Additionally, there is a valve located in the passageway, adjustable by the user, which controls the size of an orifice through which the fluid flows. Thus, as the piston is actuated by the user pushing or pulling through linkages engaging the piston rod, the encapsulated air, or other fluid, is forced from one chamber, through the orifice, to the other chamber. The force required to effect a stroke in a given time is a function of the size of the orifice. Thus, by adjusting the size of the orifice, the force required of the user may be adjusted.

Another feature of the force-resistance mechanism is that the valve allows the orifice to be completely closed off. When this is done, and when the fluid is compressible, such as air, the double-acting mechanism becomes a single-acting mechanism, wherein the forward force stroke requires an effort by the user, simultaneously storing energy in the cylinder, and wherein the return-force stroke is effected by the stored energy, requiring little or no effort by the user. This feature increases the versatility or modes of use of the machine as more fully explained below.

One end of the force-resistance mechanism is attached to the framework of the exercise machine, and the piston rod of the force-resistance mechanism is attached to one end of the lever. Additionally, a seat for the user is attached to one end of the lever.

The exercise machine is equipped with a handle for the user to grasp, whereby the user may alternately pull or push, thus flexing and unflexing his or her arms. The machine is also equipped with foot pedals on the end of the lever opposite to the seat, and against which the user may alternately push or relax, thereby exercising the legs. Thus, in at least one mode of operation of the machine, the user sits on the seat, grasps the handle with his or her hands, places the feet on the foot pedals, and proceeds to exercise by alternately pushing and pulling against the handle while simultaneously pushing and relaxing the feet against the foot pedals. As the user grasps the handle and pulls on it in a forward stroke, he or she flexes the arms, rocks forward with the torso, straightens the legs, and pushes on the foot pedals. During the reverse stroke, he or she pushes against the handle, straightens the arms, rocks back with the torso, and flexes the legs. The above-described motion is perhaps best summarized as a rocking motion, which requires that all major muscle groups of the upper extremities, lower extremities and torso are exercised synchronously, simultaneously, and bidirectionally, thus accomplishing a major objective of the invention. This synchronous, simultaneous and bidirectional exercise has been found to be highly efficient and beneficial, and is not known to be provided by any other state-of-the-art exercise machine.

In another mode of use, the user stands up rather than sits on the seat. A handle member is attached to an end of the lever, and foot support members are attached to the portion of the framework resting on the floor, at a position below the handle member. The handle is then actuated in a pumping motion.

In still another mode of use, the user stands on the pedals which are provided at one end of the lever and then grasps the handles which are mounted on the frame. The user can then proceed to alternately raise and lower his or her body. The amount of force required to raise the body can be varied by adjusting the valve in the fluid passageway on the cylinder so that a varying amount of spring is provided by the lever to either increase or decrease the assistance provided by the lever while the body is being raised.

BRIEF DESCRIPTION OF THE DRAWINGS

Reference is next made to a brief description of the drawings, which are intended to illustrate several different embodiments of the exercise machine of the present invention with respect to the manner of making and using same in its presently understood best mode. The drawings and the detailed description which follow are intended to be merely illustrative and not otherwise limiting of the scope of the invention as set forth in the appended claims.

DETAILED DESCRIPTION OF THE PREFERRED EMBODIMENTS

Reference is now made to the drawings wherein like parts are designated with like numerals throughout.

Figure 1:
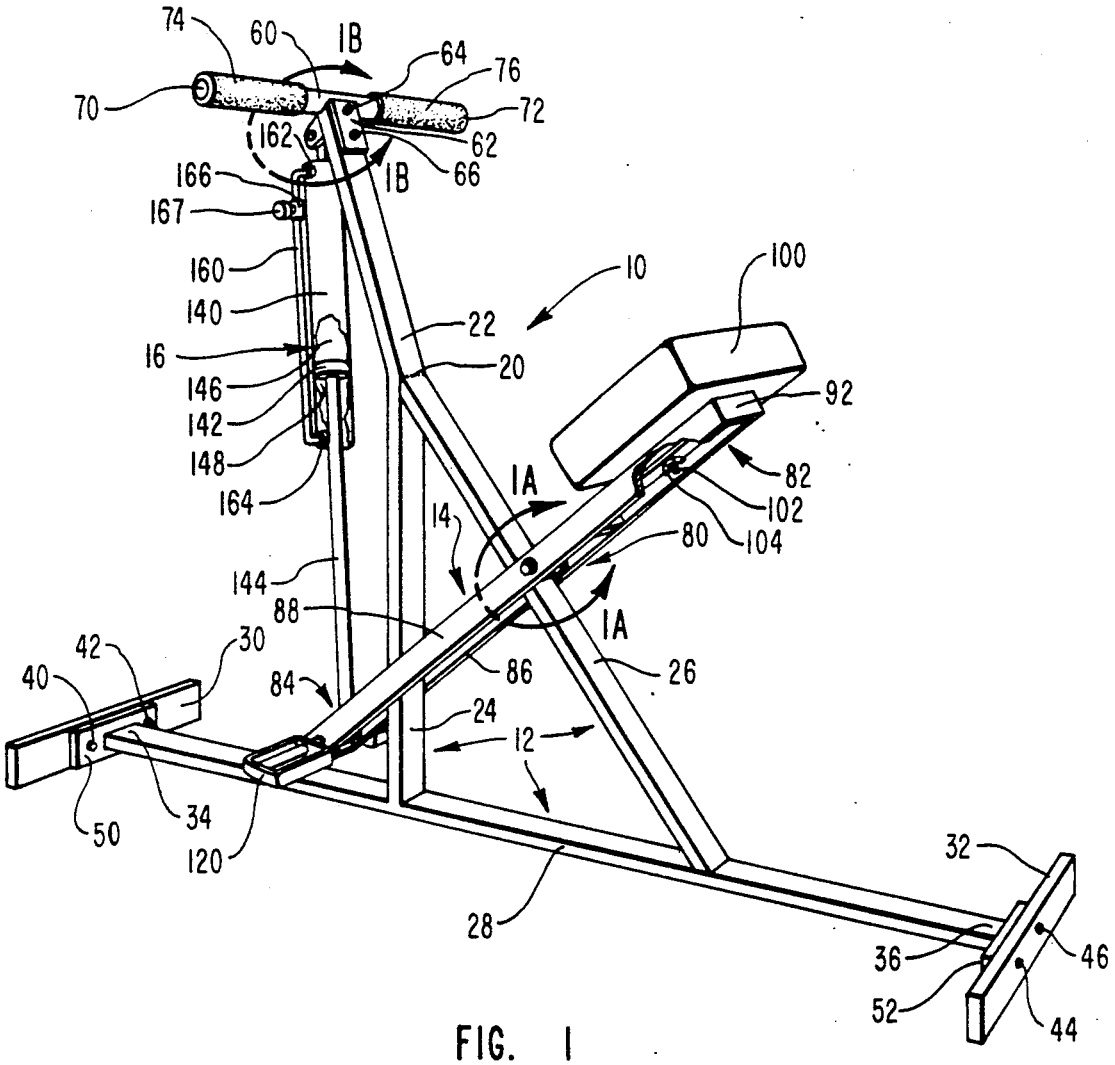
FIG. 1 is a perspective view of one presently preferred embodiment of the exercise machine of the invention.

Referring to FIG. 1, the exercise machine 10 comprises a framework 12, a lever 14, and a force-resistance mechanism 16. The framework comprises a means for providing vertical support which, in the illustrated embodiments, takes the form of an inverted "Y"-shaped member 20 having a stem 22 and two arms 24 and 26. Arms 24 and 26 are welded to a first elongate longitudinal support member 28, as shown. Support member 28 has second and third elongate longitudinal support members 30 and 32 attached in an orthogonal relationship to respective ends 34 and 36 of support member 28. Thus, support members 28, 30 and 32 together serve as a means for stabilizing the machine on a flat surface such as a floor.

"Y"-shaped member 20 and support member 28 are fashioned from steel box beams having a rectangular cross-section approximately 1" by 2". Other materials may, of course, be used such as stainless steel, aluminum, high-strength carbon, cast iron, brass, fiberglass, plastic, or wood. In any event, the cross-sectional shape and dimensions must be compatible with the material used, and must be adequate to support the machine and the body of a user in the operating modes, as more fully described below.

Support members 30 and 32 are also fashioned from stainless steel box beams having a rectangular cross section approximately 1" by 2" although of course other materials, sizes, and shapes may be used, as for members 20 and 28. Members 30 and 32 are preferably bolted by bolts 40, 42, 44, 46 to flanges 50 and 52 which in turn are welded to respective ends 34 and 36 of support member 28.

Stationary handle member 60 is fashioned from 1" stainless steel pipe, although, this is not critical. A stainless steel mounting strap 62 is welded to handle member 60, which is in turn bolted by bolts 64 and 66 to the end of stem 22 of "Y"-shaped member 20, all as shown.

Handle member 60 preferably has rubber plugs 70 and 72 inserted into, and affixed to the ends thereof. Additionally, handle member 60 preferably has rubber hand grips 74 and 76 placed over respective end portions, all as shown.

In the embodiment shown in FIG. 1 the fulcrum 80 of lever 14 is positioned intermediate the ends 82 and 84 of the lever.

Figure 2:
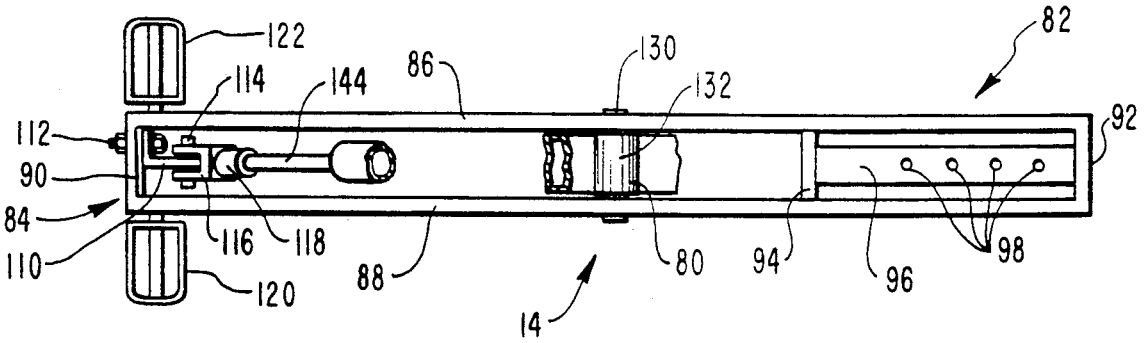
FIG. 2 is a plan view of the lever.
Figure 3:
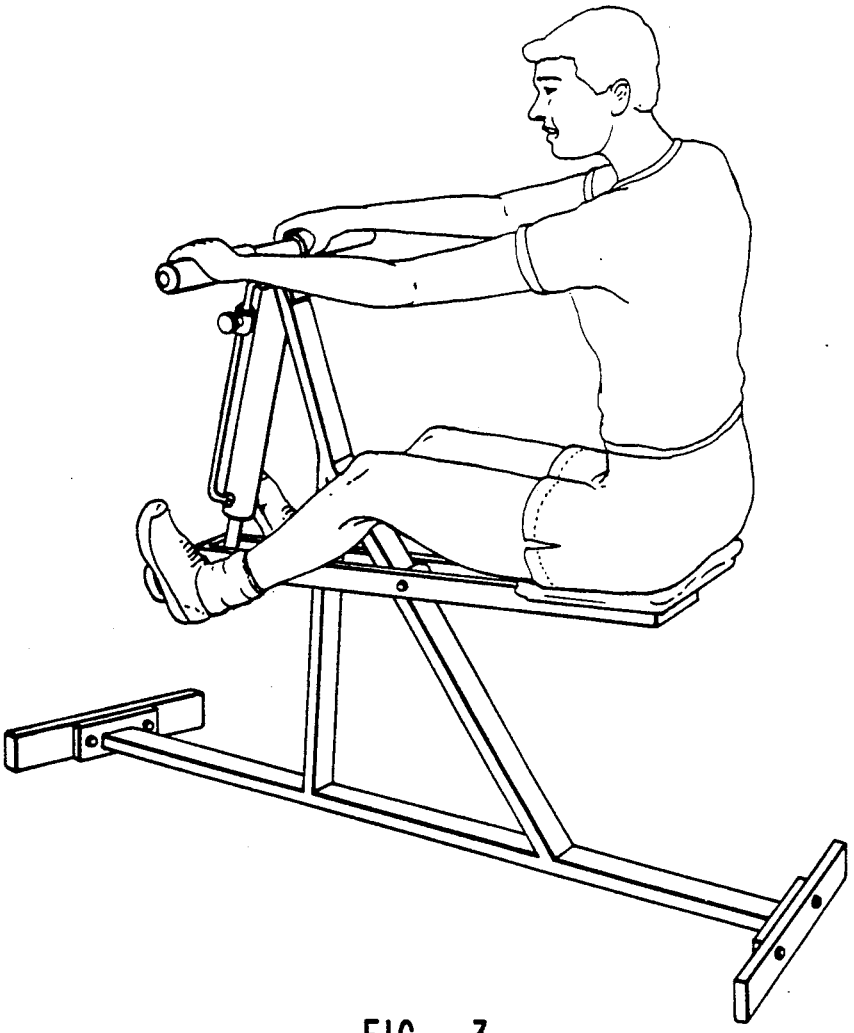
FIG. 3 is a perspective view corresponding to FIG. 1 showing a user in the process of exercising wherein the user has just completed a return-force stroke.

As shown best in FIGS. 2 and 3, lever 14 has elongate longitudinal side rails 86 and 88, interconnected at their respective ends by end rails 90 and 92. A third interconnecting rail 94 is positioned intermediate end rail 92 and fulcrum 80. A seat platform 96, serving as a seat support, is also interconnected between rails 92 and 94, all as shown.

Rails 86, 88, and 94 are fashioned from 1" by 2" stainless steel box beams, although other materials, dimensions, and shapes may be used as for the other frame members described above. End rails 90 and 92 are fashioned from stainless steel straps, ¼" by 2", although other materials and sizes may be used.

Seat platform 96 has a plurality of holes 98 fashioned therein, being devised so as to permit a seat member 100 to be suitably positioned for the individual user and fastened thereto in one of several different positions, thereby providing a means for adjusting the position of the seat member to accommodate users having different physical sizes by adjusting the distance to foot pedals 120 and 122.

Seat platform 96 is also fashioned from a stainless steel box beam, 1" by 2", being positioned such that the 2" dimension is horizontal, and the upper face is coplanar with the upper faces of side rails 86 and 88.

Seat member 100 (FIG. 1) comprises a padded seat of conventional design. A bolt 102 protrudes from the bottom of the seat member in a central location. Bolt 102 is devised to be positioned in, and protrude through, a selected one of holes 98, and to be fastened therein by a wing nut 104.

The end 84 of the lever 14 has means for attaching the piston rod 144 of force-resistance mechanism 16 thereto. An "L"-shaped bracket 110 (FIG. 2) is bolted to end rail 90 by bolt 112. A pivot pin 114 serves to pivotally attach a clevis 116, which in turn is threadedly attached to the end of piston rod 144 of force-resistance mechanism 16.

A tubular member 118, fashioned from felt or some other absorbant material, is preferably positioned around piston rod 144, thus serving to absorb a fluid on piston rod 144.

The end 84 of lever 14 also has a pair of foot pedals 120 and 122 pivotally attached thereto, by conventional means all as shown.

Figure 1A:
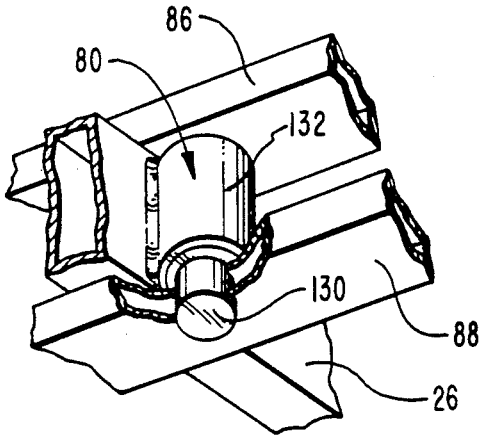
FIG. 1A is a partial perspective view of the fulcrum partially shown in FIG. 1, drawn to a larger scale.

Fulcrum 80 (FIG. 1A) comprises a pin 130 which serves to pivotally attach side members 86 and 88 of lever 14 to frame member 26 by means of a bearing 132.

In the illustrated embodiments, a force-resistance means for producing a bidirectional force which is selectively variable is comprised, for example, of a closed-end cylinder 140 having a piston 142 enclosed therein which is activated by a piston rod 144. Piston rod 144 is slidably engaged with and sealed to the end of cylinder 140 by conventional means, allowing it to slide easily but at the same time substantially preventing leakage of fluid from the cylinder.

Thus, as shown in FIG. 1 cylinder 140 has a chamber 146 on one side of piston 142 and another chamber 148 on the opposite side of piston 142. Cylinder 140 is preferably filled with air although other fluids, either gaseous or liquid, may be used.

A fluid passageway 160 interconnects ports 162 and 164 located at opposite respective ends of cylinder 140. Fluid passageway 160 is preferably fashioned from plastic tubing, although other materials may be used. Thus, as piston 142 is forced upwards in a return force stroke, fluid is forced from chamber 146 through passageway 160 into chamber 148. Similarly, on the forward force stroke fluid is forced from chamber 148 into chamber 146. Thus, the force-resistance mechanism 16 may be operated bidirectionally, requiring a force to activate it in each direction.

A conventional valve 166 is positioned in the course of passageway 160. This valve has a control knob 167 by means of which a user may adjust the size of an orifice in the valve through which the fluid must flow. Thus, as the orifice is made smaller the force required to move the piston 142 through its stroke in a given time must be increased, and vice versa. Thus, the user can adjust the exercise machine to suit his or her individual strength and conditioning needs.

Valve 166 is further adapted to close the orifice completely. When this is done, fluid cannot be forced from one chamber 146 into the other chamber 148. Rather, if the fluid is air, the air is compressed as the piston 142 is actuated in its return force stroke, thus storing energy. Then, when the force is released the compressed air expands and the stored energy then activates the piston in a forward stroke. Thus, in this mode the force-resistance mechanism 16 can be employed in a manner that requires a user to exert force in only one direction.

Figure 1B:
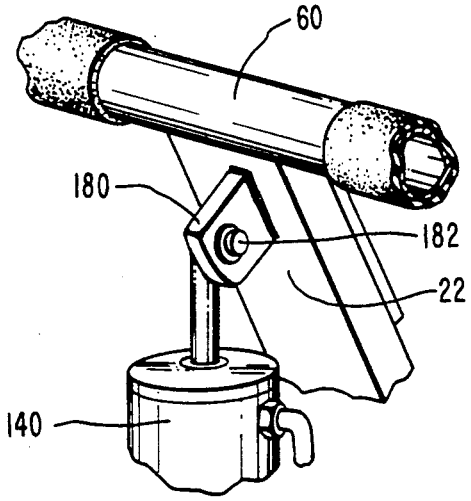
FIG. 1B is an enlarged partial perspective view showing the attachment of the force-resistance mechanism to the framework.

The force-resistance mechanism 16 is pivotally attached to stem 22 of "Y" shaped member 20 by means of a bearing-bracket 180 and pin 182, as shown in FIG. 1B.

Figure 4:
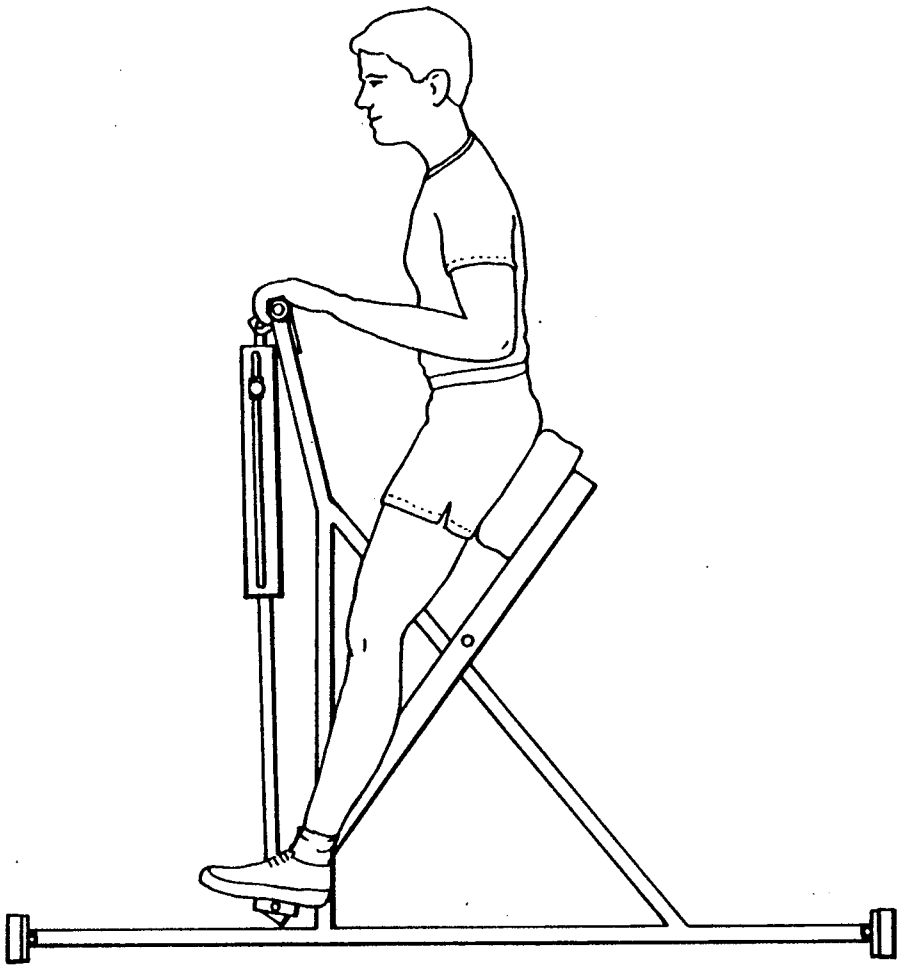
FIG. 4 is a perspective view corresponding to FIG. 3 wherein the user has just completed a forward-force stroke.

In operation, a user sits on the seat as in FIG. 3, grasps the handle member, pushes against it while straightening his arms, at the same time flexing his legs. The user then pulls against the handle (FIG. 4) flexing his arms, rocking the torso forwards, and at the same time straightening the legs and pushing down on the foot pedals, thus effecting a forward force stroke. Thus, the user exercises all major muscle groups of the upper extremities, lower extremities and torso in a synchronous, bidirectional, and simultaneous fashion. It is further to be noted that as illustrated in FIGS. 3 and 4, during both the return force and forward force strokes very little bending of the knee joints is required and furthermore there is very little change required in the curvature of the lower back. As noted above this facilitates exercise of the major muscle groups in the lower extremities and the torso notwithstanding persons having knee injuries or lower back problems. Furthermore, different muscle groups in either the upper extremities, the lower extremities or the torso can be selectively emphasized or deemphasized. For example, the rocking motion of the torso can be decreased so as to increase the work required in the upper or lower extremities, as well as keeping the arms relatively straight if desired so as to emphasize the work required in the torso and lower extremities. In this manner the machine can be utilized in a variety of ways to emphasize the degree of work required on selected muscle groups as desired.

Figure 5:
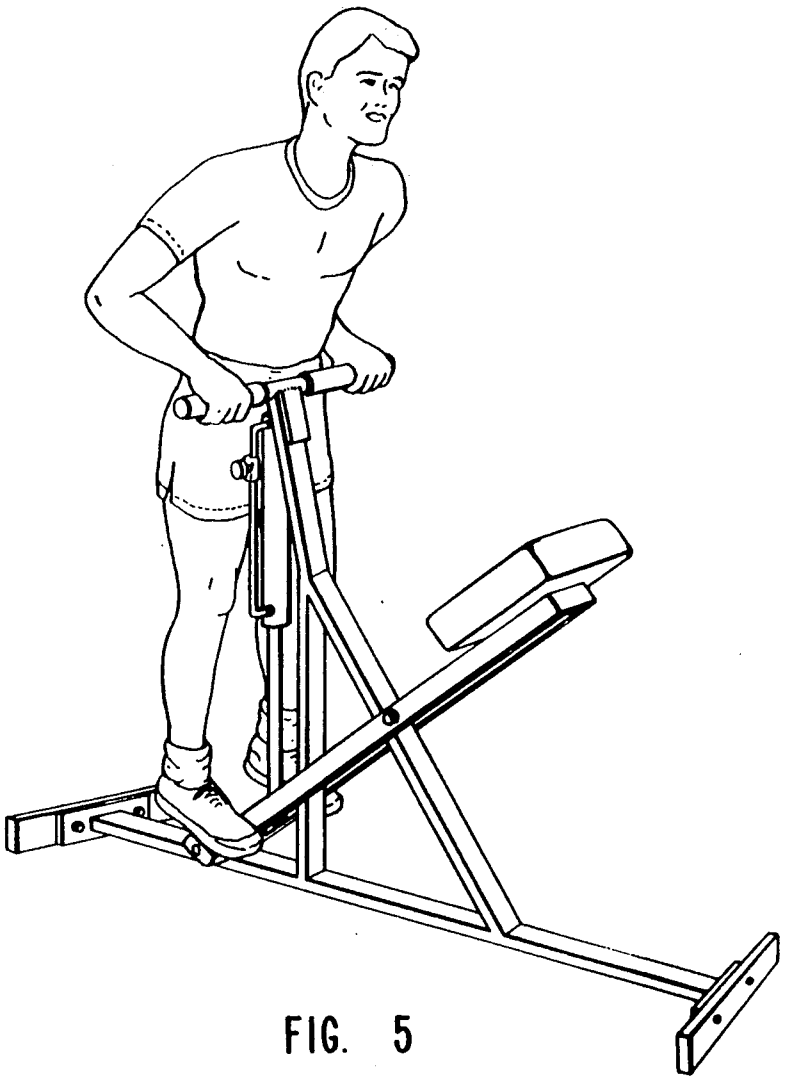
FIG. 5 is a perspective view showing a user exercising in the mode wherein he or she stands on the foot pedals and has just completed a return-force stroke.
Figure 6:
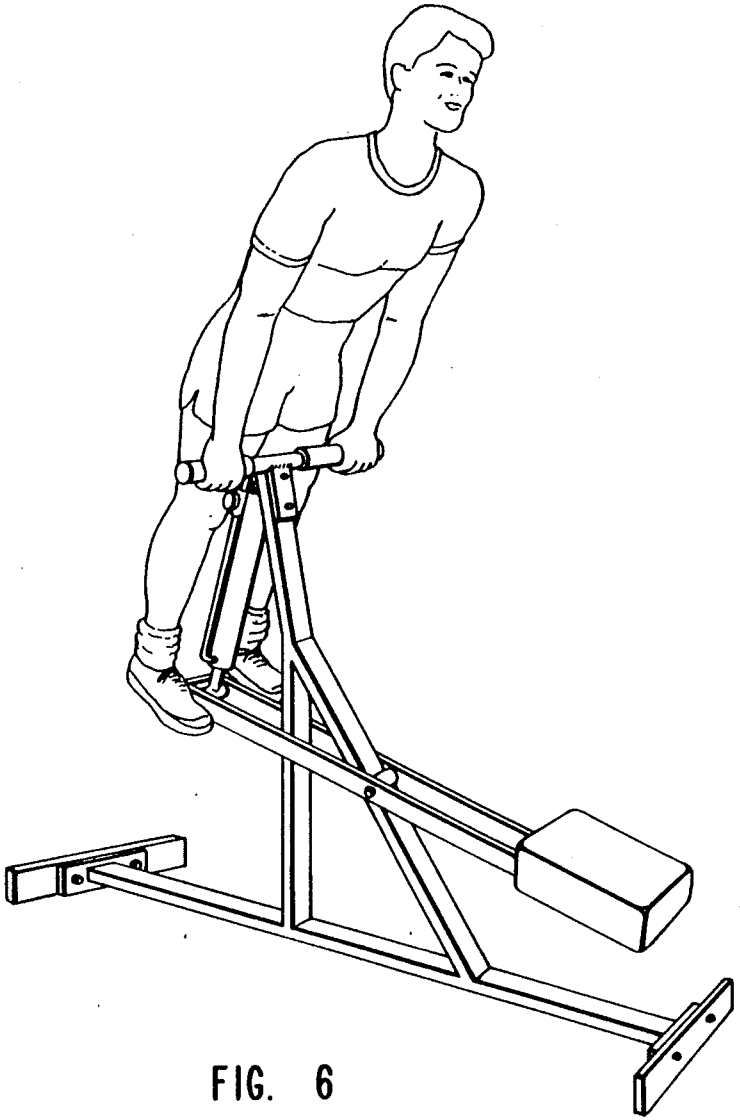
FIG. 6 is a perspective view corresponding to FIG. 5 wherein the user has just completed a forward-force stroke.

In another mode of operation the user uses the machine in such a fashion that the arms are alternately flexed and straightened and the torso muscles are exercised, but the legs remain essentially straight. To effectuate this mode the user raises the piston rod to the end of its stroke and adjusts the valve to provide the desired resistance. The user then stands on the foot pedals, which forces them downwards, and grasps the handle member, all as shown in FIG. 5. If the valve 166 has been completely closed, during this stroke the piston compresses the air in the cylinder, thus storing energy therein. Note that the user's legs are straight and the arms simultaneously raises the legs, all as shown in FIG. 6. During this stroke the stored energy in the cylinder pushes the piston rod upwards, thus helping to lift the user. The user then flexes the arms and allows the weight of the body to push downwards on the foot pedals, thus returning to the position of FIG. 5. If the user desires to increase the work done when lifting the body, the valve 166 is opened more.

Figure 7:
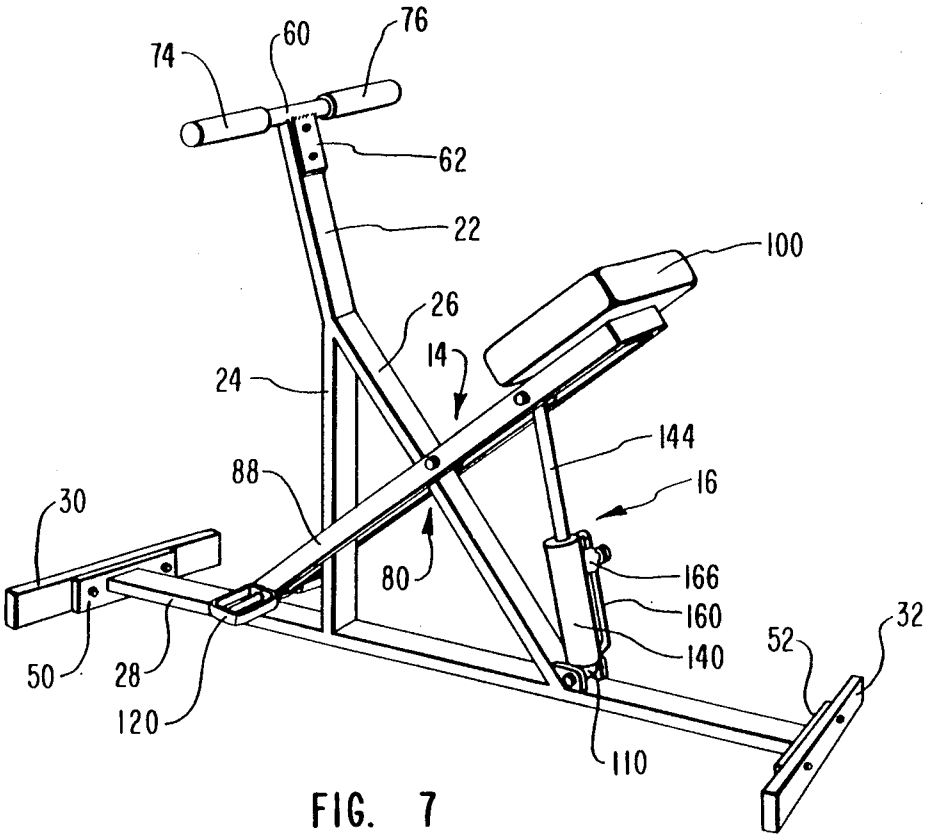
FIG. 7 is a perspective view of another embodiment of the exercise machine of the present invention.

In an alternative embodiment of the invention (see FIG. 7) the force-resistance mechanism 16 may be connected at or near the seat end of the lever. Otherwise this embodiment is constructed and will work essentially as described above.

Figure 8:
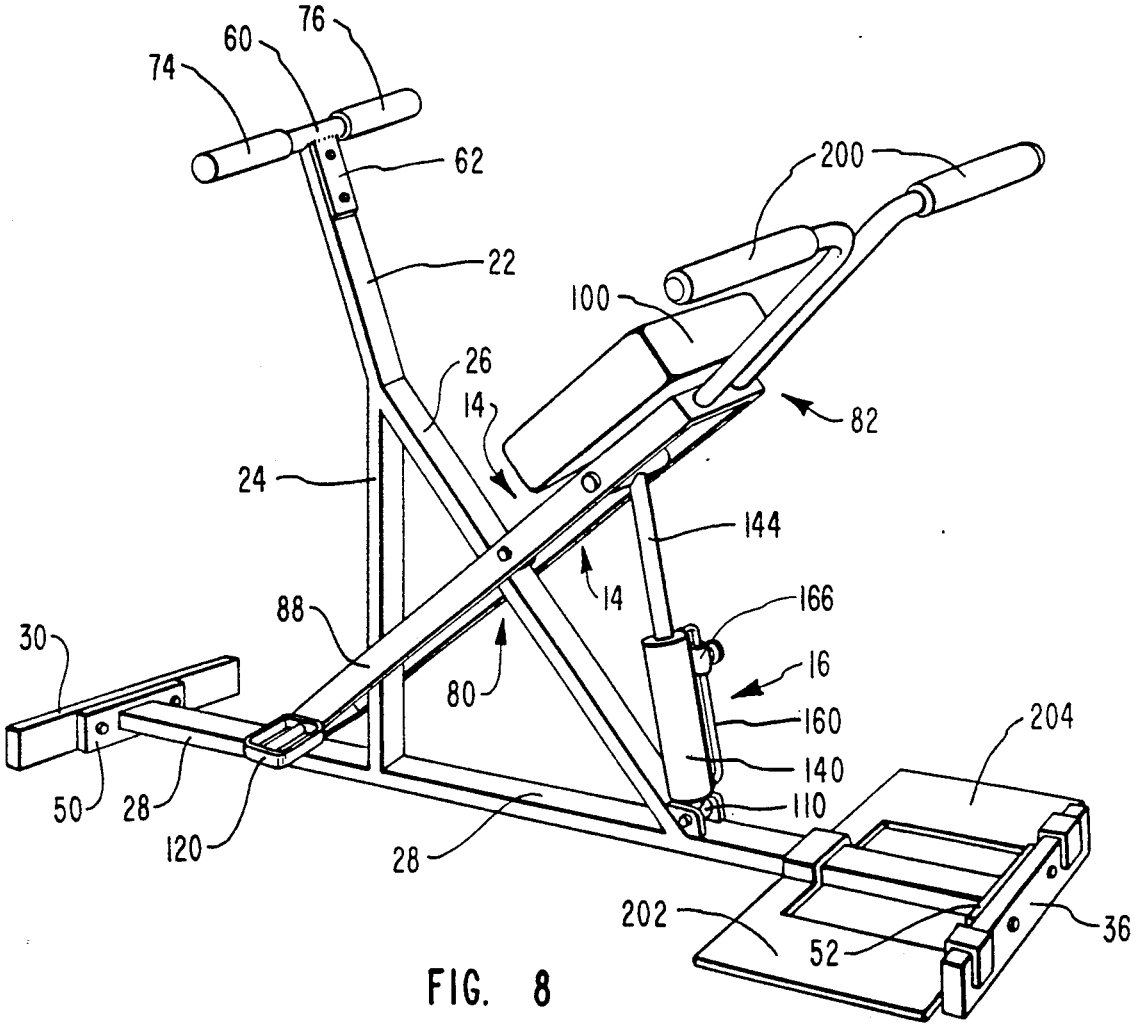
FIG. 8 is a perspective view of still another embodiment of the exercise machine of the present invention.

A still further embodiment is shown in FIG. 8. In this embodiment a handle member 200 is attached to the end 82 of lever 14, as shown. Additionally, foot-support members 202 and 204 are strategically positioned beneath handle member 200, and are attached to end 36 of elongate member 28. These foot-support members are adapted for the user to stand on while exercising. Handle member 200 and foot-support members 202 and 204 are preferably devised so as to be removably attached, although they may be fixedly attached if desired.

When using this embodiment the user stands on foot support members 202 and 204, grasps handle member 200 and pulls upwards on it, straightening the arms and the legs, in a forward force stroke. The user then pushes down on the handle member, flexing the arms and the legs in a return force stroke. Thus the user exercises the major body muscles in a synchronous, flexing the arms and the legs in a return force stroke. Thus the user exercises the major body muscles in a synchronous, bidirectional and simultaneous fashion, as before. The difference is that the exercise is done in a standing posture rather than in a sitting posture.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An exercise machine comprising:

a force-resistance means for producing a bidirectional force which is selectively variable, said bidirectional force opposing both a forward-force stroke and a return-force stroke, said force-resistance means having first and second ends;

framework means for supporting said force-resistance means, said framework means comprising a vertical support means for supporting said actuation means, and wherein said vertical support means comprises stationary handle means for providing a handle that is stationary relative to said actuation means; and actuation means, mounted on said vertical support means, for cooperatively engaging said force resistance means and said framework means to produce synchronous body movement requiring the use of essentially all major muscle groups of a user's torso, arms and legs during said forward-force stroke and during said return force stroke, and wherein one end of said force-resistance means is attached to said actuation means and the second end of said force-resistance means is attached to said framework means.

2. An exercise machine as defined in claim 1 wherein said force-resistance means comprises a cylinder with a piston.

3. An exercise machine as defined in claim 2 wherein said force-resistance means further comprises means for providing a fluid passage connecting a first end of said cylinder on one side of said piston to a second end of said cylinder on another side of said piston.

4. An exercise machine as defined in claim 3 wherein said force-resistance means comprises an adjustable valve means for variably restricting said fluid passage.

5. An exercise machine as defined in claim 1 wherein said framework means comprises a horizontal support means for stabilizing said machine on a flat surface.

6. An exercise machine as defined in claim 5 wherein said horizontal support means comprises a first longitudinal support beam, and second and third support beams orthogonally attached to said first support beam at opposite ends thereof.

7. An exercise machine as defined in claim 5 wherein said framework means comprises a vertical support means for supporting said actuation means.

8. An exercise machine as defined in claim 7 wherein said actuation means comprises a lever attached to said vertical support means at a fulcrum, and said lever being attached at one side thereof to said force-resistance means.

9. An exercise machine as defined in claim 8 wherein said lever is mounted to said vertical support means.

10. An exercise machine as defined in claim 9 wherein said force-resistance means is mounted at one end to said horizontal support means and is mounted at an opposite end to one end of said lever.

11. An exercise machine as defined in claim 10 wherein said actuation means further comprises a seat mounted on one end of said lever and foot pedals mounted on an opposite end of said lever.

12. An exercise machine as defined in claim 11 wherein said actuation means further comprises handle means for pumping said lever.

13. An exercise machine as defined in claim 12 further comprising foot support means for stabilizing said horizontal support means.

14. An exercise machine as defined in claim 1 wherein said actuation means comprises a lever attached to said vertical support means at a fulcrum, and said lever being attached at one end thereof to said one end of the force-resistance means.

15. An exercise machine as defined in claim 14 wherein said actuation means further comprises a seat mounted on one end of said lever and foot pedals mounted on an opposite end of said lever.

16. An exercise machine as defined in claim 15 wherein said force-resistance means is mounted at one end to said vertical support means and is mounted at an opposite end to said end of said lever having said foot pedals.

17. An exercise machine comprising:

a force-resistance means for producing a bidirectional force which is selectively variable, said bidirectional force opposing both a forward-force stroke and a return-force stroke, said force-resistance mans having first and second ends;

framework means for supporting said force-resistance means, said framework means comprising a vertical support means for supporting said actuation means, and wherein said vertical support means comprises stationary handle means for providing a handle that is stationary relative to said actuation means; and actuation means for cooperatively engaging said force resistance means and said framework means to produce synchronous body movement requiring the use of essentially all major muscle groups of a user's torso, arms and legs during said forward-force stroke and during said return force stroke, said actuation means comprising a lever attached to said framework means at a fulcrum, and said lever being attached at one end thereof to one end of said force-resistance means, and the second end of said force-resistance means being attached to said framework means.

18. An exercise machine as defined in claim 17 wherein said force-resistance means comprises a cylinder with a piston.

19. An exercise machine as defined in claim 18 wherein said force-resistance means further comprises means for providing a fluid passage connecting a first end of said cylinder on one side of said piston to a second end of said cylinder on another side of said piston.

20. An exercise machine as defined in claim 19 wherein said force-resistance means comprises an adjustable valve means for variably restricting said fluid passage.

21. An exercise machine as defined in claim 20 wherein said framework means comprises a horizontal support means for stabilizing said machine on a flat surface.

22. An exercise machine as defined in claim 21 wherein said horizontal support means comprises a first longitudinal support beam, and second and third support beams orthogonally attached to said first support beam at opposite ends thereof.

23. An exercise machine as defined in claim 17 wherein said lever is mounted to said vertical support means.

24. An exercise machine as defined in claim 23 wherein said force-resistance means is mounted at one end to said horizontal support means and is mounted at an opposite end to one end of said lever.

25. An exercise machine as defined in claim 24 wherein said actuation means further comprises a seat mounted on one end of said lever and foot pedals mounted on an opposite end of said lever.

26. An exercise machine as defined in claim 25 wherein said actuation means further comprises handle means for pumping said lever.

27. An exercise machine as defined in claim 26 further comprising foot support means for stabilizing said horizontal support means.

28. An exercise machine as defined in claim 17 wherein said actuation means further comprises a seat mounted on one end of said lever and foot pedals mounted on an opposite end of said lever.

29. An exercise machine as defined in claim 28 wherein said cylinder is mounted at one end to said vertical support means and said piston is mounted to said end of said lever having said foot pedals.

* * * * *

UNITED STATES PATENT AND TRADEMARK OFFICE

CERTIFICATE OF CORRECTION

PATENT NO. : 5,178,599

DATED : January 12, 1993

INVENTOR(S) : EDWIN R. SCOTT

It is certified that error appears in the above-identified patent and that said Letters Patent is hereby corrected as shown below:

Title page, Abstract, column 2, line 1, after "includes" insert --a--

Column 2, line 38, after "degree" insert --of--

Column 2, line 51, "principle" should be --principal--

Signed and Sealed this

Fourteenth Day of December, 1993

*Attest:*

Bruce Lehman

BRUCE LEHMAN

*Attesting Officer*

*Commissioner of Patents and Trademarks*